United States Patent [19]

Kit

[11] Patent Number: 4,719,674

[45] Date of Patent: Jan. 19, 1988

[54] SNAP-TYPE FASTENER

[76] Inventor: Chan Y. Kit, c/o Kit Hart Metal Fty Kwai Tak Industrial Centre, 15-33 Kwai Tak Street, Kwai Chung, New Territories, Hong Kong

[21] Appl. No.: 904,192

[22] Filed: Sep. 5, 1986

[30] Foreign Application Priority Data

Sep. 5, 1985 [GB] United Kingdom ..... 852204

[51] Int. Cl.[4] ..... A41F 1/00

[52] U.S. Cl. ..... 24/589; 24/108; 24/623

[58] Field of Search ..... 24/689, 690, 691, 698, 24/622, 621, 580, 90 C, 92, 94, 104, 108, 101 R, 101 B, 623, 574

[56] References Cited

U.S. PATENT DOCUMENTS

| | | | |
|---|---|---|---|
| 384,007 | 6/1888 | Vollmer | 24/108 |
| 558,398 | 4/1896 | Lettre | 24/108 |
| 1,047,782 | 12/1912 | German | 24/623 |
| 1,467,335 | 9/1923 | Roy | 24/108 |
| 1,840,272 | 1/1932 | Fenton et al. | 24/622 |
| 1,872,001 | 8/1932 | King et al. | 24/690 |
| 1,904,122 | 4/1933 | Chapman | 24/574 |
| 3,441,032 | 4/1969 | Barrett | 24/108 |
| 3,621,537 | 11/1971 | Andrews et al. | 24/690 |

FOREIGN PATENT DOCUMENTS

| | | | |
|---|---|---|---|
| 541524 | 12/1941 | United Kingdom | 24/623 |
| 936261 | 9/1963 | United Kingdom | 24/689 |

*Primary Examiner*—Victor N. Sakran

[57] ABSTRACT

A snap-type fastener is set forth having a female part and a male part. The female part has a casing housing a resilient member having resilient inwardly directed prongs defining an opening, the rear of the casing of the female part is closed by a disc provided with rearwardly directed prongs which serve to fix the female part to a garment. The male part has a disc provided on one side with a projection having a head portion which can be pushed through the opening formed by the resilient prongs. The male part also has prongs which serve to fix the male part to another part of the garment.

11 Claims, 7 Drawing Figures

SNAP-TYPE FASTENER

This invention relates to a snap-type fastener, more particularly to a fastener for holding two parts of a garment together in a detachable manner.

It is a principal object of this invention to provide an improved snap-fastener for garments and the like which lends itself to mass production manufacturing techniques and assembly at relatively low cost, which can be readily installed, and which is sufficiently rugged for a long useful life.

According to the present invention there is provided a snap-type fastener comprising a male part and a female part. The female part is provided with a resilient member having resilient inwardly directed prongs defining an opening which is preferably circular. The male part has a projection provided with a head portion larger than the circular opening. In use, the male projection is forced through the circular opening formed by the resilient prongs which serve to releasably retain the male projection.

Further objects and advantages of the present invention will be apparent from the following detailed description of a preferred embodiment in conjunction with the accompanying drawing in which.

The snap-type fastener comprises a female part 10 and a male part 11 which can be connected together to effect the fastening of one part of a garment to another in a disconnectable manner.

Figure 1:
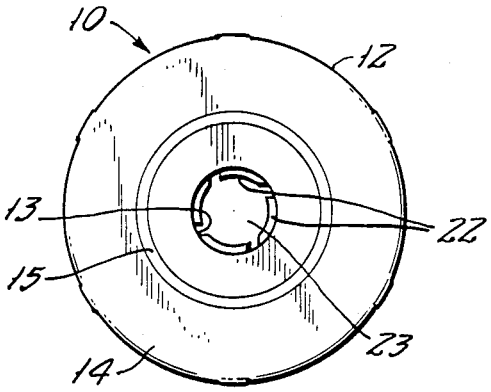
FIG. 1 is a front elevational view of the female part of a fastener constructed according to the present invention.
Figure 2:
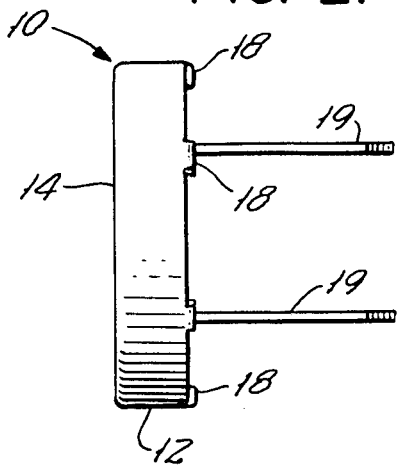
FIG. 2 is a side elevational view of the female part of the fastener.
Figure 3:
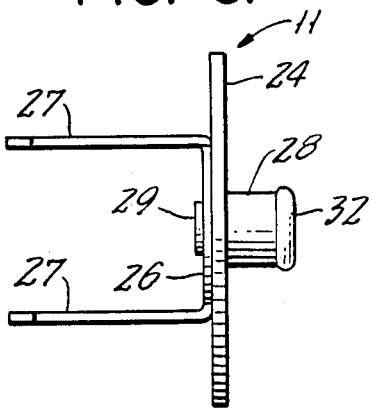
FIG. 3 is a side elevational view of a male part of the fastener.
Figure 4:
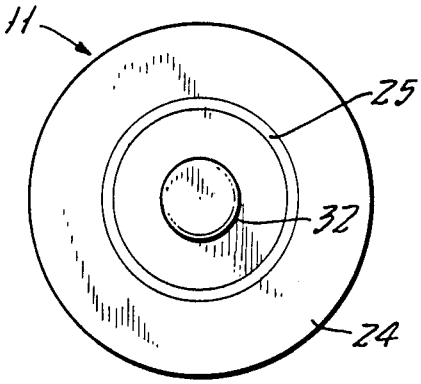
FIG. 4 is a front elevational view of the male part of the fastener.
Figure 5:
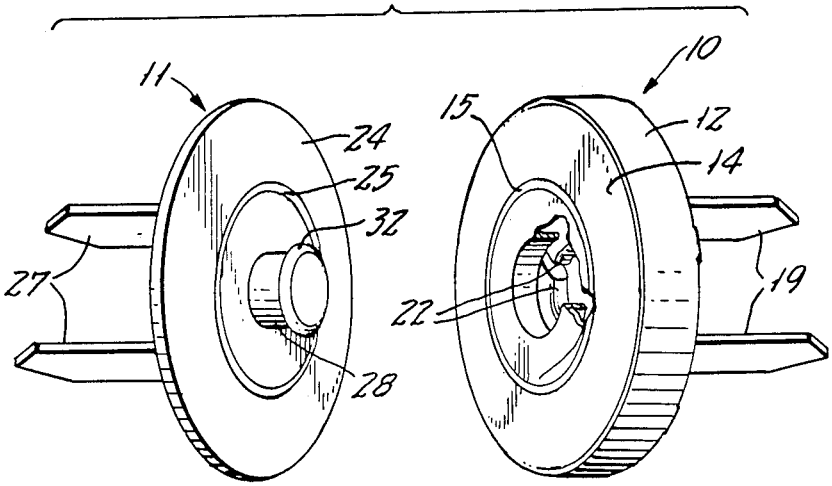
FIG. 5 is a perspective view of the male and female parts of the fastener in their disconnected state.
Figure 6:
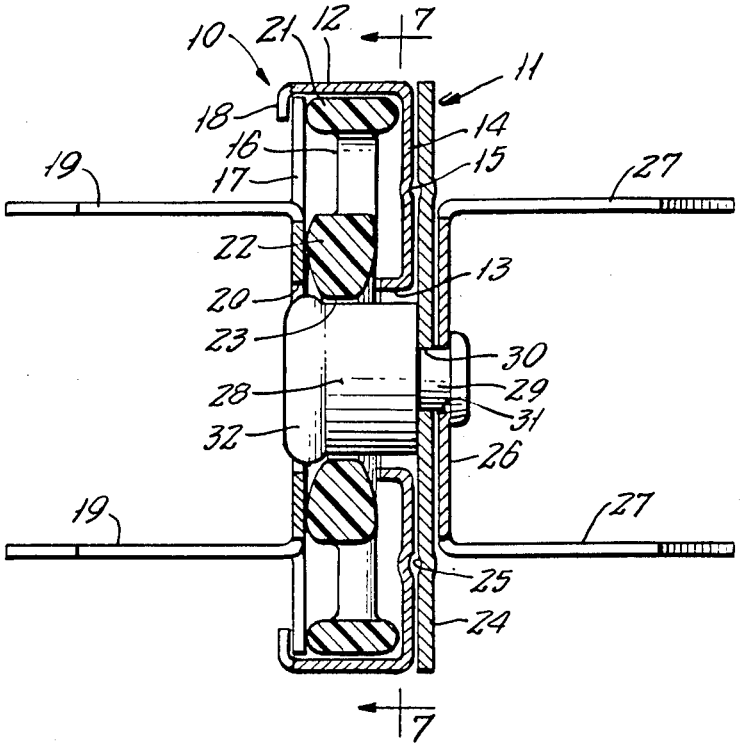
FIG. 6 is a cross-sectional view through the male and female parts of the fastener connected together.
Figure 7:
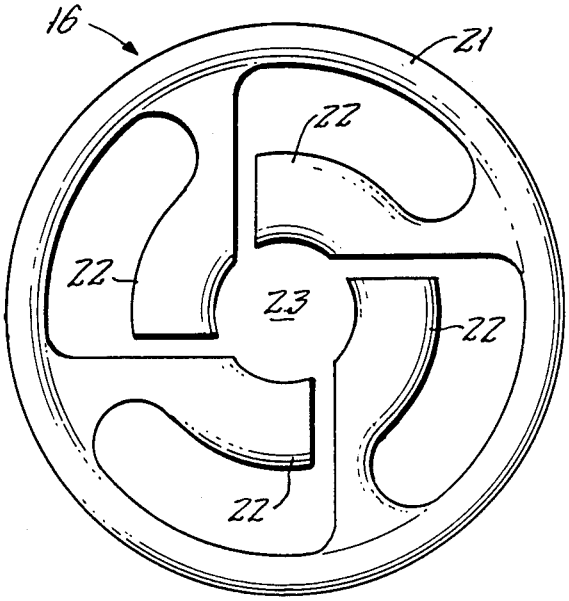
FIG. 7 is a view taken along the line 7—7 of FIG. 6 showing an end view of the resilient member of the female part of the fastener.

The female part 10 comprises a casing 12 which is circular in end view, the casing 12 having a circular hole 13 in its end face 14, the hole 13 being surrounded by a circular groove 15 provided in the end face 14. Housed within the casing 12 is a circular resilient member 16 which is shown more clearly in FIGS. 6 and 7. The resilient member 16 is retained within the casing 12 by a rear disc 17 which is held within the casing 12 by prongs 18 which are peened over the rear disc 17. Extending rearwardly from the rear disc 17 are two prongs 19 which are used to fix the female part 10 to the garment. The rear disc 17 is provided with a central aperture 20.

The resilient member 16 comprises a circular outer rim 21 from which extends four inwardly directed resilient prongs 22 which at their radially inner end define a circular opening 23. The resilient member 16 is preferably formed of a plastics material. As most clearly shown in FIGS. 6 and 7, the outer end portions of prongs 22 have reduced thickness as compared to the outer rim 21 from which they extend substantially tangentially with respect to the opening 23. That is to say, the free, inner end portion of each of the prongs 22 is displaced in relation to where it is joined to the outer rim 21. The inner and outer end portions of a given prong 22 subtend outer rim portions that are spaced apart and do not overlap. In the arrangement shown, the inner and outer portions of each of the prongs 22 are circumferentially displaced relative to one another so that the lengthof each prong 22 from its free end to where it is joined to the outer rim 21 is substantially longer than the distance between the opening 23 and the outer rim 21.

The male part 11 comprises a circular disc 24 having on its front face a circular groove 25. Provided on the base side of the disc 24 is a smaller diameter disc 26 provided with two rearwardly directed prongs 27 which are used to fix the male part 11 to the garment. Extending from the front face of the disc 24 is a projection member 28 which has a reduced diameter portion 29 which extends through a hole 30 in the disc 24 and through a hole 31 in the disc 26. The end of the portion 29 is peened over to secure the discs 24, 26 and projection member 28 together. The outer end of the projection member 28 is provided with a rounded lip 32 forming a head portion whose diameter is greater than the diameter of the circular opening 23 formed by the prongs 22 of the resilient member 16.

In use of the fastener the female part 10 is fixed by the prongs 19 to one part of a garment and the male part 11 is fixed by the prongs 27 to another part of the garment which is to be fastened in a detachable manner to said one part by means of the fastener. The projection member 28 is pushed through the hole 13 and the rounded lip 32 is forced through the opening 23 due to the resilience of the prongs 22 of the resilient member 16. The prongs 22 engage behind the rounded lip 32 and thus the male part 11 is connected to the female part 10. Disengagement is effected by forcing the male and female parts apart and thus withdrawing the lip 32 from the opening 23.

The male and female parts are preferably formed of metal, apart from the resilient member 16 which is preferably formed of a plastics material.

It will be appreciated that the prongs 19 and 27 are pushed through the garment material and then bent over.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A snap-type fastener comprising a male part and a female part, said female part being provided with a resilient member having an outer rim and resilient inwardly directed prongs with the inner end portions thereof defining a variable opening, the outer end portions of said prongs having reduced thickness as compared to said inner end portions, said prongs each extending from said outer rim in a direction substantially tangential to said opening, and said male part having a projection provided with an enlarged head portion, and said variable opening normally being smaller than said head portion so that said prongs retain said male part when its head portion has been forced through said opening, whereby in use said projection and head portion can be forced through the opening by engaging and forcing said resilient prongs to enlarge said opening to pass said head portion.

2. A snap-type fastener as set forth in claim 1, in which the inner and outer ends of each of said prongs subtends portions of said outer rim that are spaced apart from each other.

3. A snap-type fastener as set forth in claim 2 in which said prongs define a circular opening which normally has a predetermined diameter, and said head portion has a diameter larger than said predetermined diameter.

4. A snap-type fastener as set forth in claim 2, in which the female part comprises a circular casing housing said resilient member, said casing having an end face provided with a hole through which, in use, the projection of the male part can pass, the rear side of the casing being closed by a rear disc provided with rearwardly extending prongs which serve to fix the female part to a garment.

5. A snap-type fastener as set forth in claim 4, in which the male part comprises a circular disc provided on its rear side with fastener prongs which serve to fix the male part to a garment and provided on its front side with said projection.

6. A snap-type fastener as set forth in claim 5, in which said male part comprises a second disc smaller in diameter than said circular disc, fastener prongs carried by said second disc, said male part discs being provided with central apertures through which a reduced diameter portion of said projection extends and which has its outer end peened over.

7. A snap-type fastener as set forth in claim 6, in which the resilient member has an annular outer rim from which said resilient prongs extend inwardly.

8. A snap-type fastener comprising a male part and a female part, said female part including a circular casing, a resilient member housed in said casing and having resilient inwardly directed prongs defining a circular opening which normally has a predetermined diameter, saidmale part having a projection provided with an enlarged head portion larger than said circular opening so that said prongs retain said male part when its head portion has been forced through said opening, said casing having an end face provided with a hole through which, in use, the projection of the male part can pass, the rear side of the casing being closed by a rear disc provided with rearwardly extending prongs which serve to fix the female part to a garment, whereby in use said projection and head portion can be forced through the opening by engaging and forcing said resilient prongs to enlarge said opening to pass said head portion.

9. A snap-type fastener as set forth in claim 8, in which the male part comprises a circular disc provided on its rear side with fastener prongs which serve to fix the male part to a garment and provided its front side with said projection.

10. A snap-type fastener as set forth in claim 9 in which said male part comprises a second disc smaller in diameter than said circular disc, fastener prongs carrried by said second disc, said male part discs being provided with central apertures through which a reduced diameter portion of said projection extends and which has its outer end peened over.

11. A snap-type fastener as set forth in claim 10, in which the resilient member has an annular outer rim from which said resilient prongs extend inwardly.

* * * * *